United States Patent [19]

Fuchs et al.

[11] Patent Number: 4,607,255

[45] Date of Patent: Aug. 19, 1986

[54] THREE DIMENSIONAL DISPLAY USING A VARIFOCAL MIRROR

[75] Inventors: Henry Fuchs, Pittsboro; Stephen M. Pizer, Chapel Hill, both of N.C.

[73] Assignee: University of North Carolina at Chapel Hill, Chapel Hill, N.C.

[21] Appl. No.: 524,664

[22] Filed: Aug. 19, 1983

[51] Int. Cl.[4] ..... G09G 1/00; G09G 3/00

[52] U.S. Cl. ..... 340/755; 358/89; 340/720; 340/703

[58] Field of Search ..... 340/720, 791, 700; 358/90, 208, 88, 89; 340/724, 755, 703

[56] References Cited

U.S. PATENT DOCUMENTS

| | | | |
|---|---|---|---|
| 3,493,290 | 2/1970 | Traub | 340/755 |
| 4,130,832 | 12/1978 | Sher | 340/755 |
| 4,462,044 | 7/1984 | Thomason et al. | 340/755 |

*Primary Examiner*—Gerald L. Brigance

*Attorney, Agent, or Firm*—Cushman, Darby & Cushman

[57] ABSTRACT

A three dimensional display utilizes a varifocal vibrating mirror which reflects the screen on a CRT. The varifocal mirror is vibrated at a rate synchronous with creation of frames on the point plotting CRT. A video source is utilized of the type having red, green and blue outputs utilized for normally creating color display. However, the coding is such that what would normally be interpreted as red, green and blue outputs of the video source are instead interpreted as x position, y position and intensity information for a CRT accepting x, y and i signals. A depth or z coordinate is implicitly encoded in the video source at the position within a single frame of the video source where the corresponding (x, y and i) values are stored. This position can be the relative position on a magnetic or optical disc, or position around a magnetic drum. In one embodiment of the invention a raster graphics system utilizing a frame buffer is utilized. The frame buffer is divided into buckets, and the particular bucket within the frame buffer where an (x, y, i) display point is stored corresponds to the z value or depth coordinate of that point. Techniques are disclosed for interactive modification of three dimensional displays utilizing the look-up tables and registers in a standard raster graphics display system for achieving image rotation, transformation, scaling, spatial windowing, intensity windowing, cursor control, cursor inking, and blinking.

17 Claims, 8 Drawing Figures

THREE DIMENSIONAL DISPLAY USING A VARIFOCAL MIRROR

BACKGROUND OF THE INVENTION

The present invention relates to a system and method for a three dimensional display using what is known as a varifocal mirror, and was made in the course of work under a grant or award from the Department of Health, Education and Welfare.

Many areas of art deal with three dimensional data that must be visualized or manipulated. Examples include computer-aided geometric design, astronomy, air traffic control, medical imaging, and geophysical modeling. Many techniques have been developed for producing three-dimensional displays in these various areas. Shaded graphics uses obscuration, light-modeled rendering of object surfaces, and shadows. Real-time line drawing systems use the kinetic depth effect. Neither system, however, exhibits head-motion parallax, so the perceived depth cues in these systems are limited. Other methods include the display of stereo pairs, holograms, internal photography using arrays of lenses, and vibrating or rotating mirrors. Holograms and internal photography generally require long image production times and thus do not allow natural interaction. Many systems with vibrating or rotating mirrors have mechanical properties which preclude routine use. The varifocal mirror is an exception.

In a varifocal mirror three dimensional display system, the viewer does not observe i.e. a CRT screen itself, but rather the reflection of the screen in a flexible mirror—the varifocal mirror. Such a mirror is made of a flexible material, such as aluminized mylar, which is stretched taut over a rigid ring or frame. Suitable means such as a loudspeaker is mounted behind the mirror as a displacement driver for the mirror. The loudspeaker is driven by a suitable cylical signal, such as a 30 Hz sine wave, and vibrates the mirror at that frequency. Due to the mirror's vibrations, the CRT screen virtual image as seen on the varifocal mirror appears extended in depth.

There exist varifocal mirror three dimensional display systems, but such systems have required special purpose electronics for memory and image point generation, and thus tend to be relatively expensive. One such commercially available system is known as the Genisco SpaceGraph, which has been available for a price on the order of $100,000. Obviously, if a useful varifocal mirror three dimensional display system could be constructed at a significantly lower cost, say $10,000, such systems would find far wider application.

OBJECTS AND SUMMARY OF THE INVENTION

It is the object of the invention to make a varifocal mirror three-dimensional display from a color frame buffer or other standard digital color raster source. Accordingly, it is an object of this invention to provide a less expensive system and method for varifocal mirror three-dimensional display that does not require special purpose electronics for memory and image point generation and that furthermore includes features of interactive modification of the three-dimensional varifocal mirror image properties.

Briefly, in accordance with one embodiment of the invention, there is provided a standard variable focus flexible mirror such as known to those in the art along with means for cyclically deforming the flexible mirror at a predetermined rate. A standard point-plotting CRT is mounted so that its display is reflected in the flexible mirror. Such CRTs have three inputs corresponding to two-dimensional x and y position coordinates, and intensity i. A standard color raster graphics system is provided of the type which includes a frame buffer and a video scan generation system, having three outputs corresponding to red, green and blue. The crux of the invention is that these three outputs, which are normally coupled to the three color video inputs of a video monitor, in the present invention are coupled to the three inputs of the point-plotting CRT. Furthermore, the normal vertical retrace signal that usually also goes from the video scan generator to the video monitor is used in the present invention to synchronize the cyclic deflection of the mirror with the cyclic display of the data output form the frame buffer.

The system provides flexible and rapid interaction with displayed objects using the built-in programmable processor of the raster graphics system. A description of each of the objects potentially to be displayed is stored in part of the raster graphics system memory, and the processor that is part of that raster graphics system is used to transform the object descriptions into the form required for the refresh buffer, which is the part of the frame buffer on which the video scan generator is currently set to operate. Each object description consists of a set of illuminated points and/or line segments in 3-space. A line segment is described by its two endpoints. Each point or endpoint is described by 4 parameters: three coordinate position locations of x, y, and z and intensity i. At least part of the frame buffer in the color raster graphics system is used as a refresh buffer, and the refresh buffer is considered to be divided into a predetermined plurality (for example, 64) of bins or buckets, each bin coresponding to a particular nnarrow range of depth coordinate z. Each bin holds the data necessary for refreshing a number of points within the z range. Each point is stored in the space normally reserved for the red, green and blue intensities of a single particular screen picture element (pixel) in a raster graphics display. In this space is stored instead the x, y, and intensity (i) values for the point to be displayed on the point-plotting random deflection CRT of the varifocal mirror display system.

The aforementioned programmable processor inside the system carries out a sequence of two transformations on each point in the object description (see FIG. 5). The first is a standard geometric transformation of x, y, z to x', y', z' for scaling, translation, and rotation, and of i to i' for contrast enhancement. The succeeding transformation loads the resulting x', y', and i' values into the aforementioned red, green and blue fields of a location in a selected bucket of the refresh buffer, with the bucket selected according to the range in which the z' value of the point is contained.

Other objects and advantages of the various embodiments and aspects of the present invention will appear from the detailed description thereof taken in conjunction with the accompanying drawings.

Figure 1:
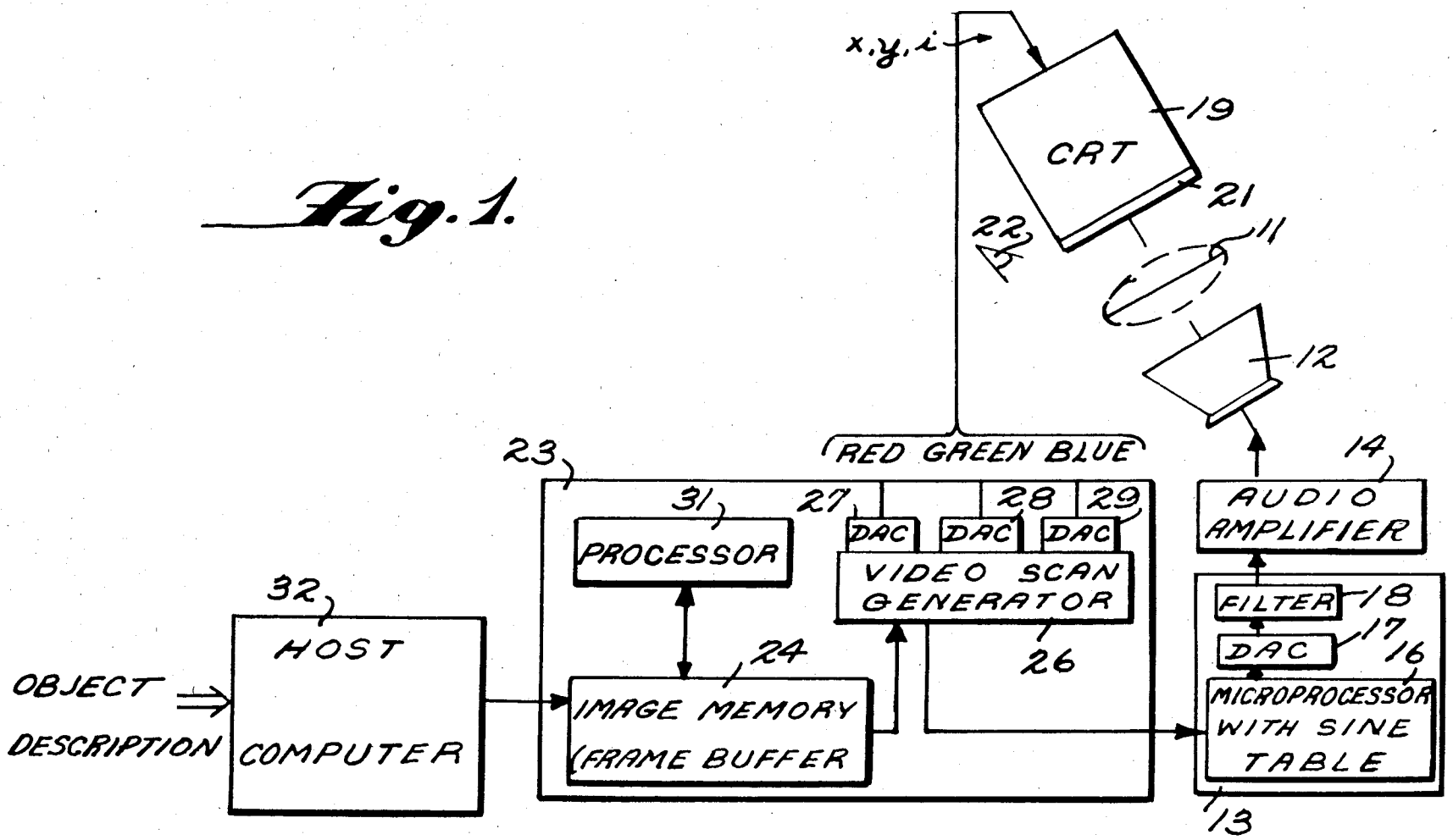
FIG. 1 is a block diagram of an overall display system in accordance with one embodiment of the invention.

Turning now to a consideration of FIG. 1, there is shown in block diagram form an overall system for three dimensional display in accordance with one embodiment of the invention. A mirror 11 is provided made of a flexible material, such as aluminized mylar, stretched over a rigid ring or the like. A loudspeaker 12 is mounted close behind the flexible mirror 11 and is driven by a smooth sine wave at an appropriate frequency. A frequency of approximately 30 Hz works well. The 30 Hz sine wave for driving the loudspeaker is created by a sine wave production system 13 coupled through an audio amplifier 14 to the loudspeaker 12. In accordance with one embodiment of the invention, the sine wave production system 13 comprises a microprocessor 16 having a sine table in memory, with the microprocessor output coupled through a digital to analog converter 17 and smoothing filter 18 to the audio amplifier 14.

A CRT 19 having a screen 21 is positioned and suitably mounted with respect to the mirror 11 such that the screen 21 is reflected by the mirror 11 so as to be visible to a viewer, generally indicated by the representation of a viewer's eye 22 in FIG. 1. The CRT 19 has three inputs, these being x and y position coordinates and the intensity i parameter. The CRT can be any suitable CRT accepting x, y and i inputs, and can even be an oscilloscope. In accordance with one embodiment of the invention, the CRT 19 is a point plotting, fast phosphor CRT available from Hewlett Packard and known as model HP 1310B.

In accordance with the invention, no special purpose and hence expensive electronics are required for memory and image point generation for driving the CRT. Instead, a standard commercially available color raster graphics system 23 is provided. Any of a wide variety of commercially available color raster graphics systems are suitable. In accordance with one embodiment of the invention, a system known as Ikonas RDS 3000 color raster graphics system is utilized. The essential portions of a suitable color raster graphics system are that it have an image memory or frame buffer 24, along with a video scan generator 26 having associated digital to analog converters 27, 28, 29 for providing the three normal red, green and blue outputs. The Ikonas RDS 3000 color raster graphics system also has a graphics processor 31, and as described hereinafter, such processor can be useful in connection with interactive control of the three dimensional display to achieve a dynamic display. A frame start signal or vertical synch signal is available in the graphics processor, (video scan generator 42) and is coupled to the sine wave production system 13 to synchronize vibration of mirror 11 (shown by dotted lines in FIG. 1) to frames of the color raster graphics system.

In accordance with the embodiment of the invention illustrated in FIG. 1 a host computer 32 may be utilized. The host computer may be any general purpose digital computer, and in accordance with one embodiment of the invention a VAX 11/780 is utilized. The purpose of the host computer is basically to transform inputs in the form of an object description into generated points which can be placed in the image memory or frame buffer 24 of the graphics system. The Ikonas RDS 3000 color raster graphics system also has graphics processor 31, and as described hereinafter, such processor can be useful in connection with interactive control of the three-dimensional display to achieve a dynamic display. The processor is used to transform the points in object descriptions into generated points which can be placed in the image memory or frame buffer 24 of the graphics system. Suitable routines for transforming object descriptions into the contents of a refresh buffer (the frame buffer 24) are known, and for example may be by use of a transformation matrix and vector generation. However, instead of simply sequentially filling the refresh buffer, the various locations in the refresh buffer are used to implicitly encode the depth or z coordinate of the point found there.

The object description can be done in the form of a simple graphics language using statements of the form (command) (position) (intensity). The commands can be Move, Draw, Point plus possibly some for scaling and control as commonly utilized in graphics systems. The (location) in accordance with the present invention consists of a three dimensional position, specified in x, y, z coordinates as in a common left-hand coordinate system.

The refresh buffer for the system (frame buffer 24 in FIG. 1) is loaded with a sequence of points from the object description. The x, y and intensity i values of each point are stored, and z is implied by the frame buffer location in which each point is stored. That is, the central concept is that the sequence of color pixel values (red, green, blue) which would ordinarily be used for a two dimensional color display instead become a sequence of two dimensional points on the point plotting CRT 19. By observing the points in the vibrating mirror 11, the virtual image is swept through some volume and the various points appear at different depths. In one half-cycle of the mirror's vibration the points early in the half-cycle appear closer to a viewer and the points later in the half-cycle appear farther away. (The reverse applies to the other half-cycle.) Thus, in order to display a three dimensional point having a particular (x, y, z, i) value, the (x, y, i) value is put into the graphics system image buffer at a location in the image buffer determined by the z value.

Figure 2:
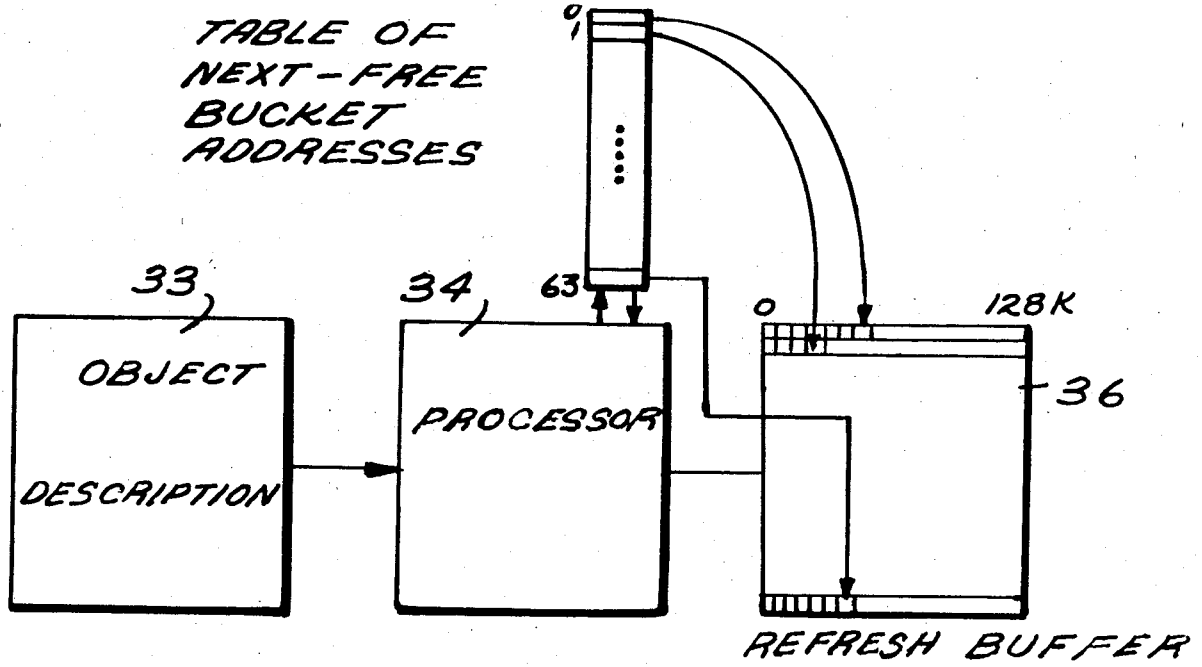
FIG. 2 is a diagram illustrating the logical organization of a refresh buffer in accordance with the invention.

Turning now to FIG. 2, there is shown a diagram illustrating the organization of the refresh buffer within the frame buffer 24 of the raster graphics system. The object description illustrated by the block labeled 33 inputs into a processor 34. The object description can be whatever is desired, and might for example be CT scan data in medical applications. The processor 34 can be a host computer as illustrated in FIG. 1. Alternatively, when using a graphics system which itself contains a processor as does the RDS 3000 system, the processor within the standard raster graphics system can be utilized. For simple static image display applications, all the processor need do is to generate the refresh buffer 36 from the object descriptions.

The two dimensional coordinates (x, y) and intensity (i) of each display point is mapped by the processor into a location in the refresh buffer that is displayed at a depth approximately equal to the z value of the point. In order to implement this mapping, the refresh buffer is divided into a plurality of buckets or bins, with each bucket or bin corresponding to a z depth value or range of z values. In FIG. 2, the refresh buffer 36 is shown as partitioned into 64 buckets (0 through 63). Of course, a fewer or greater number of partitions can be utilized, depending upon the size of the refresh buffer and the number of different depth values it is desired to have. For each point to be displayed, the x, y and intensity i values of the point (which may each be for example 8 bits) are placed in a bucket determined by the z value of the point, i.e. one of the buckets 0 through 63 in FIG. 2. One thing that needs to be taken into consideration is that since the vibrating mirror is moving sinusoidally, the mapping from a z value to a bucket location is non-linear, and the bucket sizes should vary with depth. Non-linear mapping techniques are known, and for example may be easily done by table look-up based on the high order bits of z. As shown in FIG. 2, a table 37 of pointers is maintained such as in the processor to indicate the first free location in each bucket. Insertion of a new point in a particular bucket is followed by incrementation of the pointer for that bucket.

In each mirror vibration cycle (30 Hz in accordance with one embodiment) each depth is passed twice - once when the mirror is moving front to back and once on its return. The display system can be configured to display during only one half-stroke or to display disjointed information, such as original data versus overlays, on the two different half-strokes. To display a single data base in both half-strokes, the two buckets of the refresh buffer corresponding to a given depth can be logically linked.

The single or double bucket corresponding to a given range of z values might be full when a new point needs to be inserted. The processor may be programmed to allow a search for a free space in buckets successively more distant from the desired program. Alternatively, the object description portions may be ordered from high to low priority during a preprocessing phase. Then a point encountering a full bucket during loading of the frame buffer is dropped since its priority is lower than that of all the points already in the bucket. Ordering of display points is discussed more fully hereafter in connection with interactive display manipulation.

The most simple arrangement for generating a three dimensional display in accordance with the invention utilizing a commercially available raster graphic system and a host computer, is one in which the refresh buffer is generated directly from the object description by the host computer. Such an arrangement could be used when there is no necessity for a transformation matrix, object movement, or any kind of cursor control. The object description is interpreted sequentially by the host computer and the generated points are individually placed into the frame buffer. The organization of buckets within the frame buffer and first-free bucket pointers can be maintained within the host computer as the object description is interpreted. Intrepretation consists of translating points and lines into the appropriate points within the refresh buffer. Line segments can be generated with a three-coordinate digital differential analyzer with intensity linearly interpolated between the line segment end points. Suitable algorithms for generating line segments are well known to those in this art. Reference is made, for example, to Principles of Interactive Computer Graphics, Newman and Sproull, 2nd Edition, 1979, McGraw Hill, pages 20–27. See also generally, Fundamentals of Interactive Computer Graphics, Foley and Van Dam, Addison-Wesley, 1982.

Figure 3:
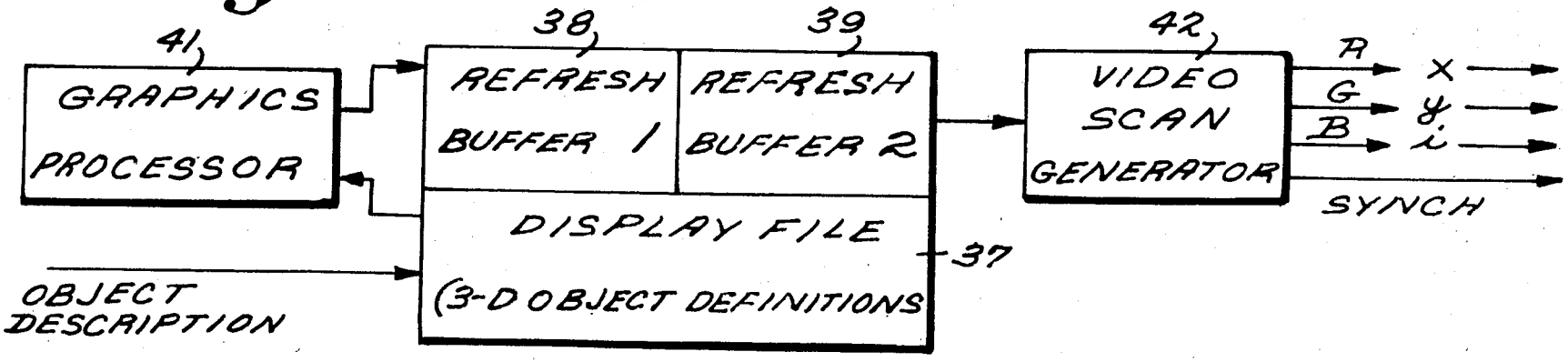
FIG. 3 is a diagram showing the organization of the image memory in an embodiment utilizing a graphics system processor.

As mentioned previously, when a raster graphic system is utilized which has a processor, as does the Ikonas RDS 3000 system, static image generation can be achieved by use of the graphics processor. FIG. 3 shows such an arrangement.

Referring to FIG. 3, in accordance with one embodiment of the invention the graphics system image memory or frame buffer is divided into a display file 37 and two separate refresh buffers 1 and 2, referred to by reference numerals 38 and 39, respectively. The object description or descriptions are input into the display file 37. The graphics processor 41 contained within the graphics system translates the object description or definitions in display file 37 into (x, y, i) triples stored at appropriate locations in the refresh buffer 38 in appropriate bins or buckets within the refresh buffer 38 corresponding to the z values of the display points. In the embodiment of the invention illustrated in FIG. 3, double buffering is used. Thus, while the first refresh buffer 38 is being loaded by the graphics processor 41, the contents of the second refresh buffer 39 are driving a video scan generator 42 for producing the R, G and B outputs, which in accordance with the present invention are the x, y and i signals for input to a y, and i signals for input to the CRT. The video scan generator 42 suitably includes digital to analog converters for producing analog X, Y, and i signals for input to the CRT.

The double buffering system is illustrated in FIG. 3. These double buffering techniques are well known in the art.

Figure 4:
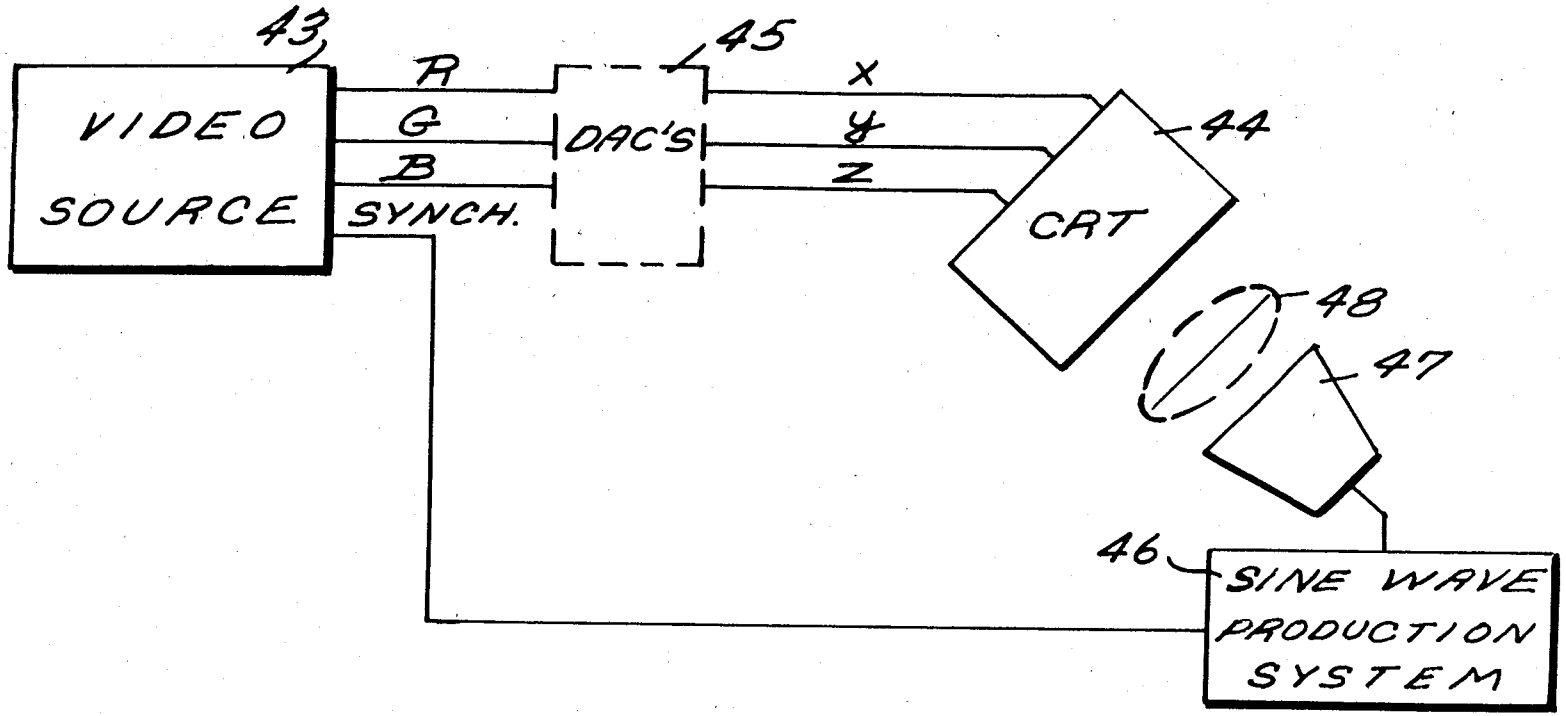
FIG. 4 is a block diagram of the broad aspects of the present invention in which a three dimensional display can be created from any video source of the type having R, G and B outputs.

Referring now to FIG. 4, the broadest aspects of the present invention are illustrated. Specifically, it is not necessary to use a raster graphics system in order to produce a static three dimensional display in accordance with the present invention. Rather, any video source of the type which produces red (R), green (G) and blue (B) outputs can utilized. Thus, in FIG. 4, there is shown a video source 43. This video source 43 can be any of the known video sources for producing R, G and B outputs. The video source 43 can thus be a magnetic or optical video disc player using magnetic or optically encoded discs, or can be magnetic drum apparatus of the Still Store type utilized for producing still frames in television broadcasting. The optical or magnetic disc or Still Store drum has encoded thereon as the R, G, and B data the x, y, and i parameters for the object or objects which are to be displayed. The position of storage of the x, y, and i data in the stored video frame on the magnetic or optical disc or Still Store drum corresponds to the z depth coordinate of the various display points.

If the data stored and output from the video source 43 is in analog form, the analog signals can be input directly into a CRT 44. If, alternatively, the data is in digital form, digital to analog converters 45 are conveniently included to transform the R G and B signals into analog x, y and i signals. A synch signal from the video source 43 is coupled to the sine wave production system 46 for driving means such as a loudspeaker 47 for vibrating the mirror 48. Utilizing an arrangement such as illustrated in FIG. 4, a very inexpensive static three dimensional display can be created from virtually any video source having R, G and B outputs. Thus, the present invention in its broadest form is the use of any video source having R, G and B inputs to generate a three dimensional display in a CRT-varifocal mirror three dimensional display system.

While static three dimensional displays in accordance with the principles of the present invention are useful, further usefulness is obtained through a variety of interactive image generation techniques. Using such techniques, displayed objects can be interactively rotated, translated and scaled. Windowing in any of the three spatial cordinates can also be achieved, as well as intensity windowing or transformation. Likewise, on-line drawing can be achieved as well as display and positioning of a three dimensional cursor under interactive control.

Figure 5:
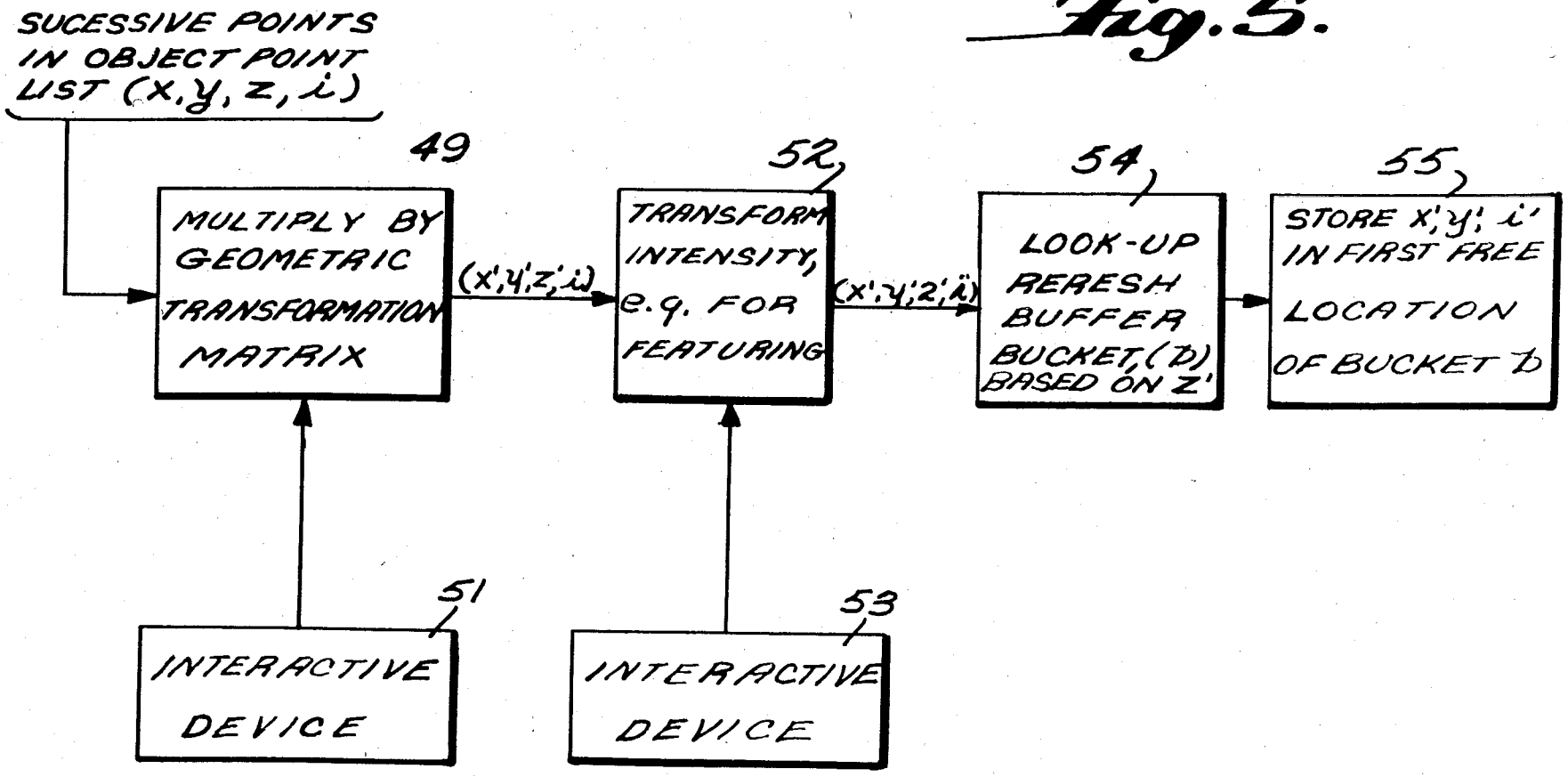
FIG. 5 is a logic flow diagram illustrating interactive geometric and intensity transformation of a three dimensional display.

Referring now to FIG. 5, there is shown a logic flow diagram for interactive geometric and intensity transforms in connection with the three dimensional display system method of this invention. Geometric transformations such as rotation of the displayed object or translation or scaling involve a geometric transformation matrix illustrated by a logic block labeled with reference numeral 49 in FIG. 5. The geometric transformation matrix 49 is generated by whatever processor is utilized in response to an input or inputs from an interactive device 51. The interactive device 51 can be any of those well known in this art such as a joystick, track ball, or slider. The geometric transformation matrix 49 transforms the object description coordinates into a new set representing either a rotated object, a scaled object, or a translated object. These coordinates are shown in FIG. 5 as (x', y', z', i). Suitable algorithms and programs for generating the geometric transformation matrix 49 are well known in the computer graphics art. Reference is made, for example, to Principles of Interactive Computer Graphics, Newman and Sproull, 2nd Edition, 1979, McGraw Hill, pages 333–336.

As shown in FIG. 5, an intensity transform can also be provided, as illustrated by the block 52. A transform of intensity might be useful for example in highlighting one of a plurality of objects in the three dimensional display. The transform of intensity is also under the control of an interactive device 53 which can be a slider, knob or the like. The output of the intensity transform block 52 are the new display point values (x', y', z', i'). A logic block 54 illustrated in FIG. 5 determines the proper bucket (b) in the refresh buffer into which each display point is to be stored based on the z' value of that display point. As indicated by logic block 55, the x', y', and i' values, representing the transformed data points, are stored in the first free location of the bucket selected on the basis of the new z' value in the refresh buffer.

Figure 6:
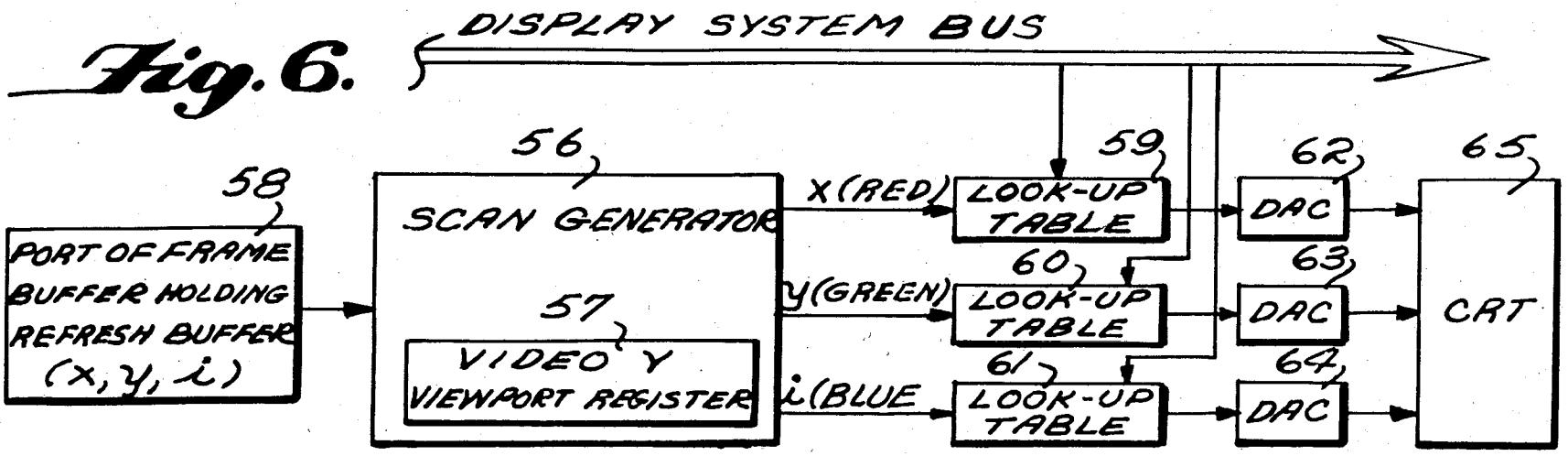
FIG. 6 is a block diagram illustrating x, y and z interactive windowing in the display as well as interactive contrast enhancement.

Turning now to consideration of FIG. 6, there is shown a block diagram of the arrangement utilized in accordance with the invention for spatial and intensity windowing useful in real time interactive modification of the three dimensional image on the varifocal mirror. The scan generator of many raster graphics systems, including the Ikonas RDS 3000, contains viewport registers for X and Y spatial windowing of displays. This is illustrated in FIG. 6 by the scan generator 56 shown as having a video Y viewport register 57. The part of the frame buffer holding the refresh buffer illustrated by block 58 in FIG. 6 inputs into the scan generator 56. Viewport registers and their use in interactive graphic systems are known in the art. Reference is made, for example, to Principles of Interactive Computer Graphics, Newman and Sproull, 2nd Edition, 1979, McGraw Hill, pages 74–75. The video-Y viewport register 57 in a raster graphic system provides spatial windowing along the Y dimension of a two dimensional display during a normal raster scan. The Y dimension during normal raster scanning is a time dependent function. However, in accordance with the present invention the display is not a raster scan, and the frame buffer is divided into a plurality of buckets, with each of the buckets corresponddng to a particular depth or z value. By using the video Y viewport register 57, loaded from the display system bus and set for example using an interactive device such as a slider or knob, particular z or depth values within the three dimensional display can be spatially windowed for viewing. In essence, what the viewport register does is set the intensity of the points at all Y values other than those selected at black, so the only display which appears corresponds to the Y values of interest. In accordance with the present invention, that video Y viewport register setting translates into particular depth coordinates z of the three dimensional display. In this manner, a particular depth or depths within an object can be spatially windowed for three dimensional viewing.

Typically, raster graphic systems include look-up tables for transforming the R, G and B outputs of a scan generator for input into a CRT. Such look-up tables have been provided in the past for uses such as correcting the R, G, B signals for nonlinearities inherent in a phosphor display device. In accordance with the present invention, those look-up tables, illustrated by blocks 59, 60 and 61 in FIG. 6, which are loaded from the display system bus, can be utilized for interactive x and y spatial windowing as well as intensity windowing. The look-up tables are loaded along a display system bus from a host computer or other processor utilized in the display system in response to settings of suitable interactive devices. As before, these interactive devices can be sliders or knobs or the like for selecting the spatial windowing. The look-up table associated with the normal red input, which in accordance with one embodiment of the present invention is the x spatial coordinate, can be utilized for spatial windowing along the x coordinate axis. Similarly, the look up table 60 provided in association with the normal green video component can be used for interactive spatial windowing in the y dimension on the three dimensional display. The look-up table 61 normally used in connection with the video blue signal, which corresponds to the intensity i in the present invention, can be utilized for intensity windowing or contrast enhancement of selected portions of the three dimensional display. The outputs of the look up tables 59, 60 and 61 are converted into analog signals bv respective digital to analog converters 62 63 and 64 to form the x, y,and i inputs to a CRT 65.

In terms of interactive control of displayed objects, such as object rotation, there are two competing considerations involved in selecting the form that display points are stored. Using a point plotting CRT, it is possible that the CRT beam might be deflected from one point to the next all the way across the CRT face. There is a practical limit to deflection time for a CRT without causing "smearing" or other degradation, this being generally on the order of 100–200 nanoseconds. This problem does not arise in raster systems since the CRT beam is being scanned between adjacent points in a raster pattern. In a point plotting system, one way to account for the necessary beam deflection time is to create and store display points with zero intensity between each of the object points. Thus, for each (x, y, i) triple to be stored in a particular depth bucket, there is created a point (x, y, O) followed by (x, y, i). This arrangement allows twice as much time for beam deflection between random points on the CRT screen. However, if this arrangement is utilized, it is only possible to store half as many points in the refresh buffer as would otherwise be the case.

One way to overcome this beam deflection time problem is to order the display points within the buckets of the refresh buffer so that successive points are close enough to be displayed at successive "pixel" times without smearing. Algorithms and routines for such ordering of display points are known in the computer graphics art.

Ordering of display points can, however, lead to another problem in interactive modification of the three-dimensional display. In, for example, interactive rotation of the displayed three dimensional object using a three dimensional joystick, the processor repeatedly interrogates the joystick and generates a transformation matrix (see FIG. 5) from the rotational values input by the user. The transformation matrix is used to transform the object description coordinates before filling the refresh buffer. In many cases, the entire object cannot be transformed and the refresh buffer loaded with all the new points in real time. To deal with this, the object definition or description can be set up so that its initial portion contains a coarse description of the entire object. After this initial portion has been transformed, the system checks whether the user position (i.e. joystick) controls have changed during one frame time; if they have, the initial portion is again transformed for the next frame, according to the new input values. If the controls have not changed, the remaining parts of the object definition are transformed in succeeding time frames. In this way, the object display responds to the user without delay, while allowing display of the object in complete detail whenever the user slows or stops movement of the controls.

To arrange the object description so that its initial portion contains a coarse description, it is sufficient to merely randomly order the image points in the object description. Suitable routines for randomizing the image points are known, and in fact many processors include utility programs useful for such randomizing of data.

Figure 7:
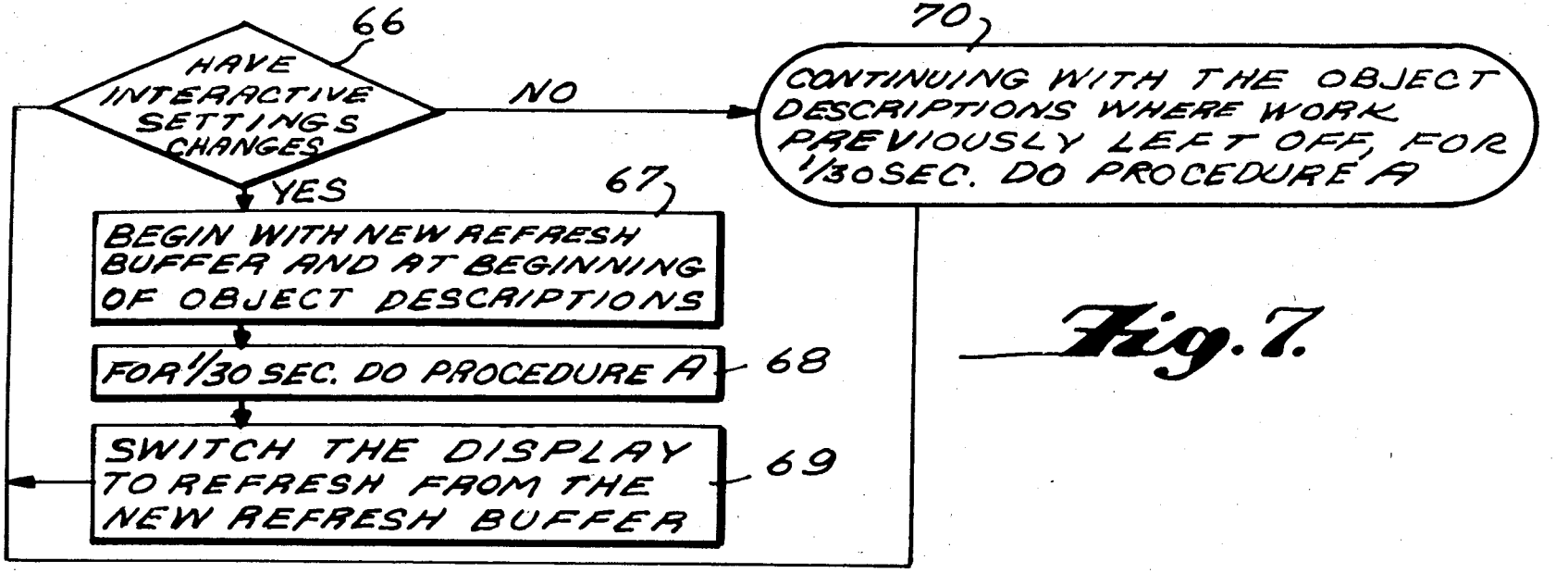
FIG. 7 is a logic flow diagram illustrating a routine associated with loading a refresh buffer during interactive image modification.
Figure 8:
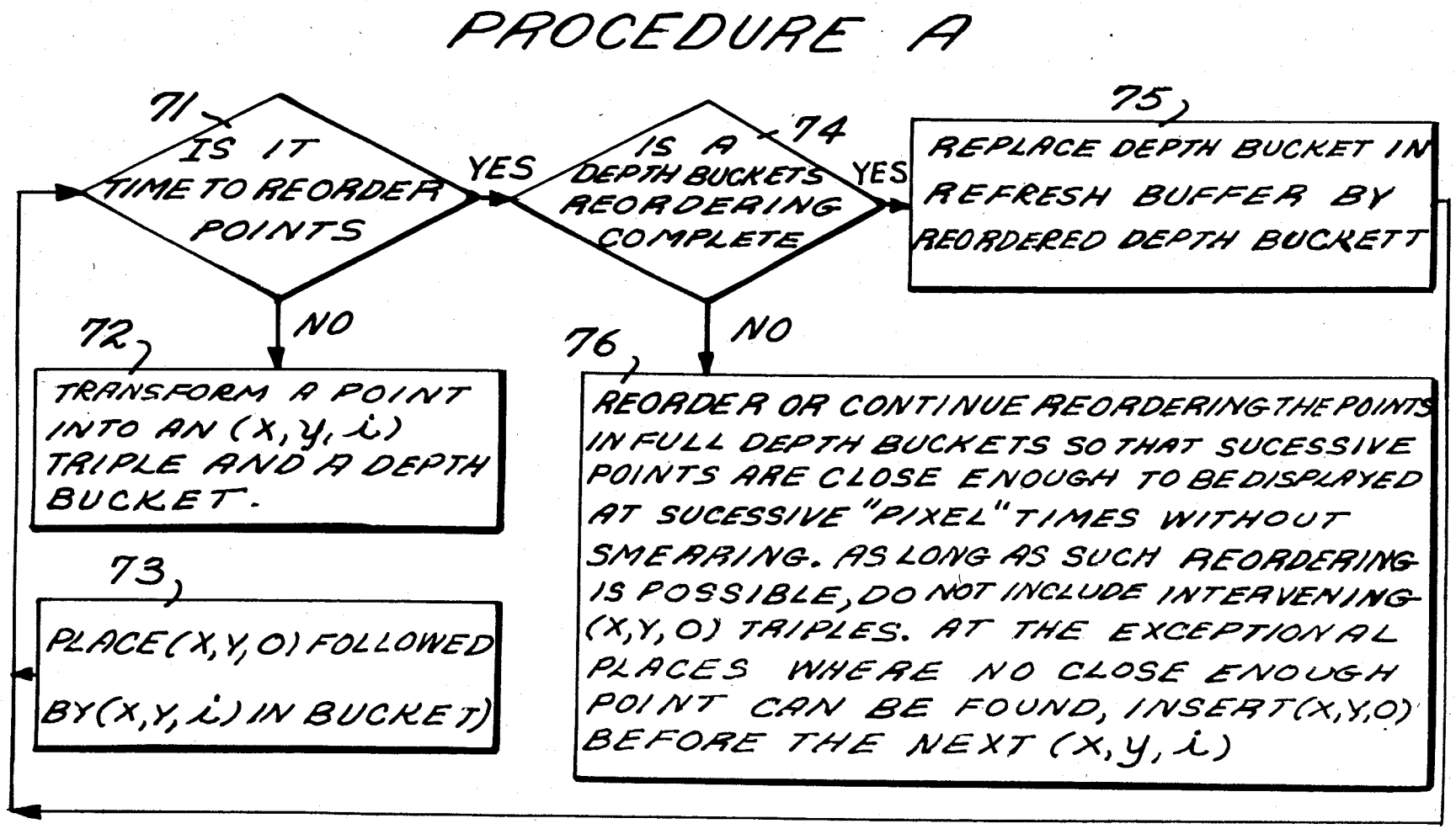
FIG. 8 is a logic flow diagram illustrating am image point ordering routine useful in interactive image modification.

Referring now to FIGS. 7 and 8, there is shown logic flow diagrams for routines useful in connection with the present invention for accommodating real time interactive control of the object display, while at the same time maximizing the amount of display points which can be stored in a refresh buffer of given size. FIG. 7 assumes that the image points have been randomized in a preprocessing phase, and illustrates successive refinement by repeated transformations during interactive display object transformation. Decision block 66 in FIG. 7 refers to whether or not the interactive settings have changed. That is, for example whether or not new rotational values through a three dimensional joysticks are being input by the user. If the interactive settings have changed, the system begins with a new refresh buffer and at the beginning of the object descriptions as referred to in block 67. The new refresh buffer is assembled for as long as possible, this being 1/30th of a second in accordance with the embodiment of the present invention wherein a 30 Hz mirror cycle is utilized. Thus, as referred to in block 68, for 1/30th of a second the new refresh buffer is assembled in accordance with a procedure A (discussed hereafter in connection with FIG. 8). Then, the newly assembled refresh buffer, to the extent it could be assembled in that 1/30th of a second, is switched to the display as indicated by block 69, and the routine is routed back to block 66.

If, in response to the initial decision at the block 66 it is determined that the interactive settings have not changed, i.e. the user is rotating the object at a slower rate or object rotation has stopped, then the no decision leads to a decision block 70, indicating that the routine continues with the object description where work was previously left off for an additional 1/30th of a second, and performs procedure A.

Referring now to FIG. 8, there is shown a logic flow diagram for the procedure A referred to in FIG. 7. Procedure A is repeated for each point (in their random order) from the object description. Decision block 71 in FIG. 8 refers to whether or not it is time to reorder the points. There are a number of forms which this decision might take. For example, the decision could be made on whether or not any depth bucket is full. The decision could also be made on whether or not all of the depth buckets are full, and the decision could also be made on whether or not all objects are completely transformed. In any event, using whatever definition is desired, if it is decided that it is not time to reorder the points, as shown by the block 72 the point is transformed into an (x, y, i) triple and a depth bucket based on its z value and as shown by decision block 73 there is inserted into the refresh buffer a point (x, y, 0) followed by (x, y, i) in the appropriate bucket corresponding to the z coordinate of the point. As discussed previously, this insures that the beam of the CRT has sufficient time to deflect from point to point without smearing.

If the determination by decision block 73 is that it is time to reorder the points, as indicated by decision block 74 a determination is made of whether a depth bucket's reordering is complete. If the reordering is complete, then as indicated by decision block 75 the depth bucket in the refresh buffer is replaced by the reordered depth bucket. If the decision at block 74 is that a depth bucket's reordering is not complete, then as indicated by decision block 76 reordering is initiated or continued. Basically, the points in depth buckets which are full are reordered so that successive points are close enough to be displayed at successive "pixel" times without smearing. As long as such reordering is possible, the intervening (x, y, 0) triples are not included because they are not necessary. If a close enough point cannot be found to a previous point so as to permit beam deflection thereto without smearing, then as indicated in decision block 76 an (x, y, 0) triple is inserted before the next (x, y, i).

Utilizing the procedures illustrated in FIGS. 7 and 8, manipulation of an object display, such as rotating the display, responds to the user without delay with at least a coarse description of the rotated object appearing at all times. This coarse position is defined by as many of the randomized object points as can be transformed during a cycle, 1/30th of a second in accordance with one embodiment of the invention. When, however, the rotation slows or interactive rotation is stopped, then the complete object descriptions are transformed in successive 1/30th of a second cycles so that a detailed display of the rotated object is provided. At the same time, as illustrated in FIG. 8, as long as the depth buckets are not full or a particular depth bucket is not full and the objects are not completely transformed, transformation takes place with insertion of an (x, y, 0) followed by (x, y, i) in the appropriate bucket corresponding to the z location, so as to permit time for the CRT beam to be deflected from point to point anywhere in the display. When, however, a depth bucket or all of the depth buckets are full, or all objects have been completely transformed, then procedure A performs a reordering of the points eliminating the (x, y, 0) points where feasible because of the proximity between adjacent display points. Utilizing these routines, real time interactive control of the object display is accommodated while at the same time maximizing the amount of display points which can be stored in a refresh buffer of given size.

In addition to the interactive modification of the three dimensional display in accordance with the invention as has been discussed above, various other enhancements can be made. For example, it can be desirable to have a cursor in the three dimensional display under interactive control of a user. This is easily achieved by reserving a few locations at the end of each bucket in the refresh buffer solely for the cursor. The cursor can be moved by erasing its current position and writing it into its new one. Similarly, interactive image generation in the three dimensional display can be achieved by "inking" the cursor's positions. This is simply done by putting the cursor's point into a regular location in the appropriate bucket in the refresh buffer whenever the cursor is moved. Of course, while most of this description has referred to an object display in the three dimensional display, it is possible to display a plurality of objects. Each of the objects can be individually manipulated in accordance with the interactive controls as discussed herein, or selected ones of the objects can be highlighted for display by the spatial and intensity windowing discussed above. Thus, for examphe, intensity modification can be achieved through use of the blue video look up table which controls the intensity output to the CRT. Higher intensities can also be achieved by repeating points of highlighted objects into the refresh buffers so the beam of the CRT will spend significantly more time at the points of highlighted objects than at points of unhighlighted ones.

It is also possible to achieve a blinking capability in the three dimensional display. This, for example, could be done by allocating one bit of however many number of bits are used per pixel/point specification. The intensity ("blue") look up table can be switched between two different sets of values at the blinking rate to force blink-marked points to zero intensity during half of each blink cycle. This appears in the display as a blinking of the selected points.

While the present invention has been described by reference to particular preferred embodiments thereof, it should be clear that various modifications and changes can be made to any of these embodiments without departing from the true spirit and scope of the invention. The invention in its broadest scope is applicable to creation of a varifocal three dimensional display utilizing any video source of the type which provides what ordinarily would be red, green and blue outputs. Thus, a three dimensional display utilizinig a varifocal mirror can be achieved using standard color video sources, with appropriate encoding of an optical or magnetic disc being utilized, or the frame buffer in a raster graphics system. This permits implementation of a very inexpensive three dimensional display. In particular, utilizing a standard commercially available raster graphics system, and without any special purpose electronics, very powerful interactive image manipulation of the three dimensional display can be achieved.

We claim:

1. Three dimensional display apparatus comprising: a video storage source of the type having three outputs normally interpreted as red, green and blue outputs for creating a color display and also having a frame synchronization output; a storage medium of said video storage source storing video frames for each normally red, green and blue data instead x position, y position and i intensity corresponding to image points in a three dimensional object to be displayed, the z depth position coordinate for each said image point being implicitly encoded in the storage medium by the location at which the x position, y position and i intensity are stored within each particular video frame stored in said storage medium; a point position display device having x position, y position and intensity inputs; means coupling said three outputs of said video storage source to said three inputs of said CRT; a varifocal vibrating mirror positioned so as to reflect a screen of said display device; and means for vibrating said mirror at a rate synchronized with the frame synchronization of said video storage source, whereby a virtual image observed by a viewer looking at the vibrating mirror is a three dimensional image.

2. Three dimensional display apparatus in accordance with claim 1 wherein said video storage source is a video disc player and said storage medium is an optically encoded disc.

3. Three dimensional display apparatus in accordance with claim 1 wherein said video storage source is a video player for reproducing video from a magnetically encoded medium and said storage medium is magnetically encoded.

4. Three dimensional display apparatus in accordance with claim 1 wherein said video storage source is a raster graphics system and said storage medium is a frame buffer.

5. A process for producing a three dimensional display using a video storage source of the type having three outputs normally interpreted as red, green and blue outputs for creating a color display and also having a frame synchronization output, comprising the steps of:

encoding on a storage medium of the video storage source for each normally, red, green and blue data instead x position, y position and i intensity parameters corresponding to image points in a three dimensional object to be displayed, the x, y, i parameters for each particular point being stored on the storage medium at a particular location thereof corresponding to a z position depth coordinate associated with each such particular point;

coupling the three outputs of said video storage source to x, y, i inputs of a point position display device;

positioning a varifocal mirror so as to reflect images on the CRT; and vibrating the varifocal mirror at a rate synchronized with the frame synchronization of the video storage source, whereby a virtual image observed by a viewer looking at the vibrating mirror is a three dimensional image.

6. Three dimensional display apparatus comprising:

a varifocal flexible mirror;

means for cyclically deforming said flexible mirror at a predetermined rate;

a point position display device having three inputs of x position, y position and i intensity, said display device being mounted so that its display is reflected on said varifocal flexible mirror;

a color raster graphics system including at least a frame buffer and display point generation system and having three outputs corresponding to red, green and blue parameters in normal use of said color raster graphics system when creating two dimensional color graphics displays;

a synchronization control coupled between said display point generation system and said means for cyclically deforming said mirror for synchronizing frames with said predetermined rate of mirror deformation;

means for coupling said three outputs of said color raster graphics system to said three inputs of said display device;

means for generating an object description of an object to be three dimensionally displayed, said object description including three coordinate positions of x, y and z and intensity i;

means for functionally dividing said frame buffer into a predetermined plurality of buckets, each bucket corresponding to a particular range of depth coordinate z;

means for transforming the object description into contents of said frame buffer, with the x, y and i values being mapped into a selected bucket of said frame buffer, the bucket selected corresponding to the z value of each said respective point, whereby frame buffer functions as a refresh buffer for said display device and the virtual image observed on said varifocal flexible mirror is a three dimensional image.

7. Three dimensional display apparatus in accordance with claim 6 wherein said means for transforming the object description into contents of said frame buffer comprises a processor.

8. Three dimensional display apparatus in accordance with claim 6 wherein said color raster graphics system includes a processor, and wherein said frame buffer is functionally divided into a display file for storing object descriptions and a refresh buffer for storing x, y and i values in buckets selected in accordance with respective z values, said processor coupled to the display file and refresh buffer for transforming said object description into contents of said frame buffer.

9. Three dimensional display apparatus in accordance with claim 6 wherein said means for cyclically deforming said flexible mirror at a predetermined rate comprises a sine wave production system coupled to a loudspeaker positioned adjacent said mirror.

10. Three dimensional display apparatus in accordance with claim 7 including a user-controlled interactive device coupled to said processor for effecting geometric transformations of the three dimensional image on said mirror, said processor generating a transformation matrix for transfcrming x, y, z values into x', y', z' values in accordance with settings of said interactive device and said processor loading the x', y', z' values into the refresh buffer.

11. Three dimensional display apparatus in accordance with claim 7 including a user-controlled interactive device coupled to said processor for effecting intensity transformations of the three dimensional image on said mirror, said processor generating a transformation matrix for transforming i values into i' values in accordance with settings of said interactive device and said processor loading the i' values into the refresh buffer.

12. Three dimensional display apparatus in accordance with claim 7 wherein said display point generation system includes a video Y viewport register loaded from said processor for use in normally selecting only portions of a two-dimensional raster scan stored in said frame buffer along a Y dimension for display, and wherein settings of said viewpoint register function to select only portions of the three dimensional image for display corresponding to z depth coordinates stored in the selected portions of said frame buffer.

13. Three dimensional display apparatus in accordance with claim 7 wherein said color raster graphics system includes look-up tables for transforming the normal red, green and blue outputs of said system which correspond to x, y and i outputs coupled to said display device, said look-up tables being coupled to and loaded by said processor, and wherein settings of said look-up tables effect windowing of x, y, i values in three dimensional display.

14. A process for producing a three dimensional display comprising the steps of:

providing a varifocal flexible mirror;

cyclically deforming the flexible mirror at a predetermined rate;

providing a point plotting display device having three inputs of x position, y position and i intensity;

mounting the display device so that its display is reflected onthe varifocal flexible mirror;

providing a color raster graphics system of the type including at least a frame buffer and display point generation system and having three outputs corresponding to red, green, and blue parameters in normal use of said color raster graphics system when creatIng two dimensional color graphics displays;

synchronizing frames generated by the display point generation system with the cyclic deformation of the mirror;

coupling the three outputs of the color raster graphics system to the three inputs of the display device;

generating an object description of an object to be three dimensionally displayed with the object description including points specifid by three coordinate positions of x, y and z and intensity i;

functionally dividing the frame buffer into a predetermined plurality of buckets with each bucket corresponding to a particular range of depth coordinate z;

transforming the object description into contents of the frame buffer including mapping the x, y, i values into a selected bucket of the frame buffer, with the bucket selected corresponding to the z value of each of the respective points;

whereby read out of the frame buffer through the display point generation system to the display device produces a three dimensional display of the object on the varifocal flexible mirror.

15. A process in accordance with claim 14 including the step of providing a processor to transform the object description into contents of the frame buffer.

16. A process in accordance with claim 15 including the step of providing a user-controlled interactive device coupled to the processor for effecting geometric transformations of the three dimensional display produced on the mirror including the step of generating a transformation matrix for transforming x, y, z values of display points into new points having x', y', z' values in accordance with settings of the interactive device, and loading the x', y', z' values into the frame buffer.

17. A process in accordance with claim 15 wherein the frame buffer is divided into at least two refresh buffers, with one refresh buffer driving the display point generation system while the other buffer is being loaded during a frame period, and including the step of randomizing the order of the x', y', z' points prior to loading them into the frame buffer so that if there is not sufficient time to load into the other buffer a complete set of new x', y', z' points during a frame period, the new points which are loaded provide at least a coarse display of the transformed points during the next succeeding frame period.

* * * * *